US007827718B2

(12) United States Patent
Luebkert et al.

(10) Patent No.: US 7,827,718 B2
(45) Date of Patent: Nov. 9, 2010

(54) HAND-HELD POWER TOOL WITH AN IDENTIFICATION ELEMENT

(75) Inventors: Ernst-Rudolf Luebkert, Landsberg (DE); Hans Appel, Munich (DE); Pierre Pallmer, Igling (DE); Armin Oeffling, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 306 days.

(21) Appl. No.: 12/151,773

(22) Filed: May 8, 2008

(65) Prior Publication Data

US 2008/0282850 A1 Nov. 20, 2008

(30) Foreign Application Priority Data

May 11, 2007 (DE) ..... 10 2007 000 269

(51) Int. Cl.
*G09F 3/02* (2006.01)

(52) U.S. Cl. ..... 40/625; 40/913

(58) Field of Classification Search ..... 40/625, 40/626, 628, 629, 913, 299.01; 173/170
See application file for complete search history.

(56) References Cited

U.S. PATENT DOCUMENTS

| | | | | | |
|---|---|---|---|---|---|
| 1,709,321 | A | * | 4/1929 | Railsback | 40/625 |
| 2,913,951 | A | * | 11/1959 | Buren, Jr. | 411/517 |
| 3,183,613 | A | * | 5/1965 | Rojc et al. | 40/642.02 |
| 3,769,725 | A | * | 11/1973 | Stewart, Jr. | 40/643 |
| 5,573,825 | A | * | 11/1996 | Brewster | 428/43 |
| 2004/0112777 | A1 | * | 6/2004 | Huang | 206/349 |
| 2005/0279517 | A1 | * | 12/2005 | Hoffman et al. | 173/29 |

* cited by examiner

*Primary Examiner*—Gary C Hoge
(74) *Attorney, Agent, or Firm*—Abelman, Frayne & Schwab

(57) ABSTRACT

A hand-held power tool includes a housing (4), and a tag-shaped identification element (14.1; 14.2) mountable on the housing (4) so that it becomes visible on an outer side of the housing (4), provided with an identification mark (16.1; 16.2), insertable in a receptacle (20.1; 20.2) provided on the housing.

5 Claims, 4 Drawing Sheets

HAND-HELD POWER TOOL WITH AN IDENTIFICATION ELEMENT

BACKGROUND OF THE INVENTION

1. Field of the Invention

The present invention relates to a hand-held power tool, in particular electrical power tool, including a housing and an identification element which, e.g., can be formed separately from the housing, is provided with an appropriate identification mark, and is mountable on the housing so that it becomes visible on the outer side of the housing from outside. The present invention also relates to a method of manufacturing such a tool, in particular, the identification element.

2. Description of the Prior Art

In the hand-held power tools of the type discussed above, certain data such as, e.g., mark, indication of the type of the power tool, or serial number of the power tool are clearly visible on the apparatus housing. In particular, with a separate manufacturing of the indication element from the remaining of the housing and a subsequent at least partial handling of the indication element, a particularly elegant execution of the indication is possible.

German Utility model DE 20 2004 020 518 U1 discloses a hand-held power tool with lettering being provided on a separate part of the power tool housing. During the manufacturing of the power tool housing, this separate part is placed in the housing mold and becomes surrounded with the plastic material the housing is made of when the remaining portion of the housing is injection-molded. The lettering is formed of another material than the housing of the power tool.

With the known approach, the lettering can be produced from a particularly scratch-resistant material in order to retain a clear impression over the service life of the power tool.

The drawback of the known power tool consists in that the power tool housing already includes the lettering upon being produced and, therefore, is suitable only for a corresponding type of power tools. However, in particular, during manufacturing of a series of power tools with different types of power tools which, however, have the same housing, it makes sense when the housing is suitable, after its production, for all of the power tool types of the series. In this case, the housings can be produced and stored for all of the power tool types and only later be distributed between separate types of the power too, as needed.

Accordingly, an object of the present invention is to provide a power tool in which the drawbacks of the known power tool are eliminated, and a simple lettering or label is provided that can be used firstly, after the housing has been produced.

SUMMARY OF THE INVENTION

This and other objects of the present invention, which will become apparent hereinafter, are achieved by forming the identification element as a tag that is pushed into a correspondingly dimensioned receptacle formed in the housing.

According to the present invention, the housing has, after being produced, a predetermined position for the indication element. The proper indication mark of the housing and its mounting can be effected later, e.g., during the end assembly of the power tool. In addition, the subsequently insertable, in the receptacle, indication element provides for its separate handling and an easy affixing of the indication mark.

According to a particularly advantageous embodiment of the present invention, the indication element can be secured in the receptacle by a third element of the power tool. This enables a simple, cost-effective and long-lasting fixation of the indication element in the power tool housing.

Advantageously, the securing element has a locking region, and the identification element has a formlocking element that abuttingly engages the locking region of the securing element in a direction opposite the direction in which the identification element is pushed into the receptacle, when the indication element is positioned in the receptacle. Thereby, in a simple way, a stable and precisely positioned fixation of the indication element relative to the power tool housing is insured.

Advantageously, the third tool element is formed by an air guide which is produced separately from the housing and then inserted in the housing. At that, e.g., an elastic locking region can be formed on the air guide in a particularly simple manner and which the formlocking element of the identification element can engage. Alternatively, it can be provided that the air guide is inserted into the housing only after the positioning of the indication element therein, with the locking region being so formed that upon insertion of the air guide, it engages the formlocking element from behind, blocking the displacement of the indication element relative to the receptacle.

Advantageously, the indication mark is arranged in a recess formed in the indication element. Thereby, the indication mark is protected from scratches, in particular when the power tool is laid down.

Advantageously, the receptacle is provided in a recess formed in the housing. Thereby, double-walling, which requires additional constructional space and a greater material consumption is prevented.

It is particularly advantageous when both the identification element and the receptacle taper in the direction in which the identification element is pushed into the receptacle. This insures an exact positioning of the indication element when it is pushed in the receptacle.

Advantageously, the hand-held power tool includes two identification elements of the type discussed above which are provided on two sides of the power tool housing.

The method of manufacturing such a hand-held power tool includes forming a power tool housing provided on two of its sides thereof with two receptacles, respectively, forming two identification elements dimensioned in accordance with respective dimensions of the two receptacles, as parts of a single cast element, providing the two identification elements with respective identification marks in a single printing process, separating the two identification elements and inserting the two identification elements in the respective receptacles. The foregoing method provides for a particular cost-effective manufacturing of the indication elements and of applying indication marking thereon.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
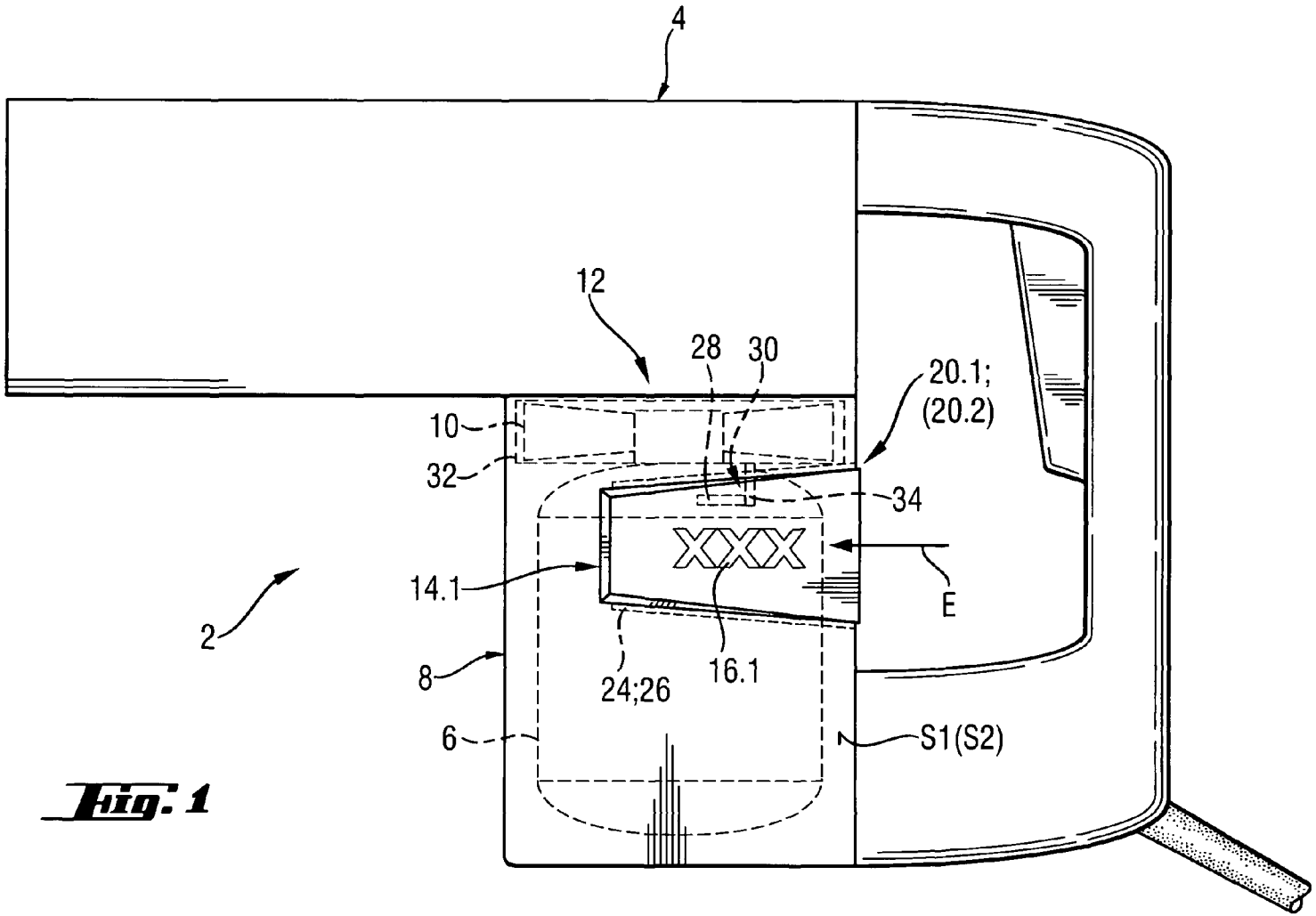
FIG. 1 a side view of a hand-held power tool according to the present invention.

An electrical hand-held power tool 2 according to the present invention, which is shown in FIG. 1 and is formed as a hammer drill, includes a multi-part housing 4 and a motor 6 for driving the power tool 2 and located in a motor housing part 8. The motor 6 is cooled by an aeration device 10 which is located at the upper end of the motor housing part 8.

As shown in FIG. 1, a tag-shaped first identification element 14.1 is secured on a first side S1 of the motor housing part 8. On the first identification element 14.1, a first identification mark 16.1 is provided. The first identification mark 16.1 can contain letters or figures, marking, a pictogram, here, e.g., indicated with XXX, or a mixed form. The first identification mark 16.1 is formed on the first identification element as a print or embossing, or by other means bonded to the first identification element 14.1.

Figure 2:
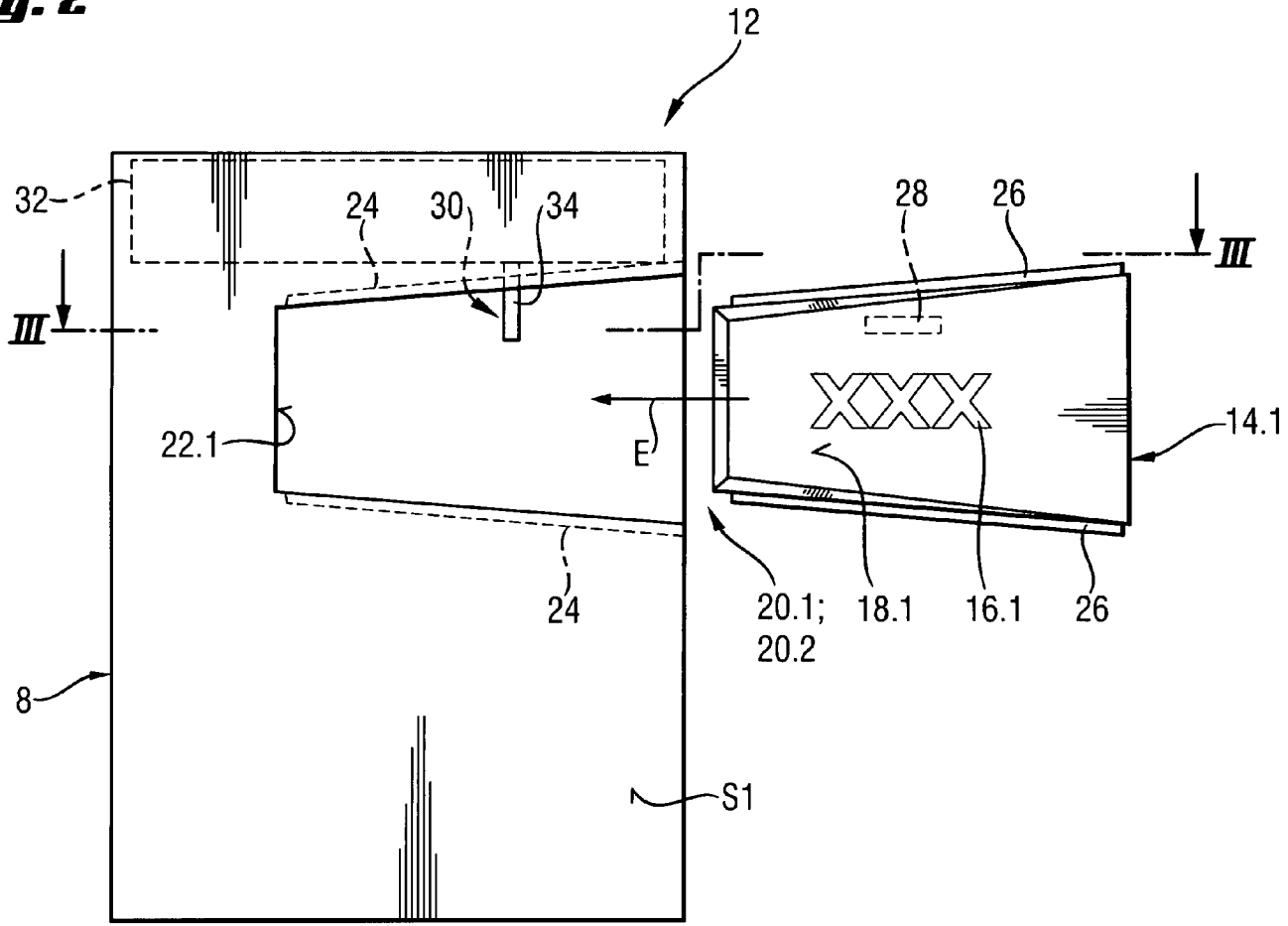
FIG. 2 a side view of motor housing part of the hand-held power tool shown in FIG. 1, with the identification element being pulled out.
Figure 3:
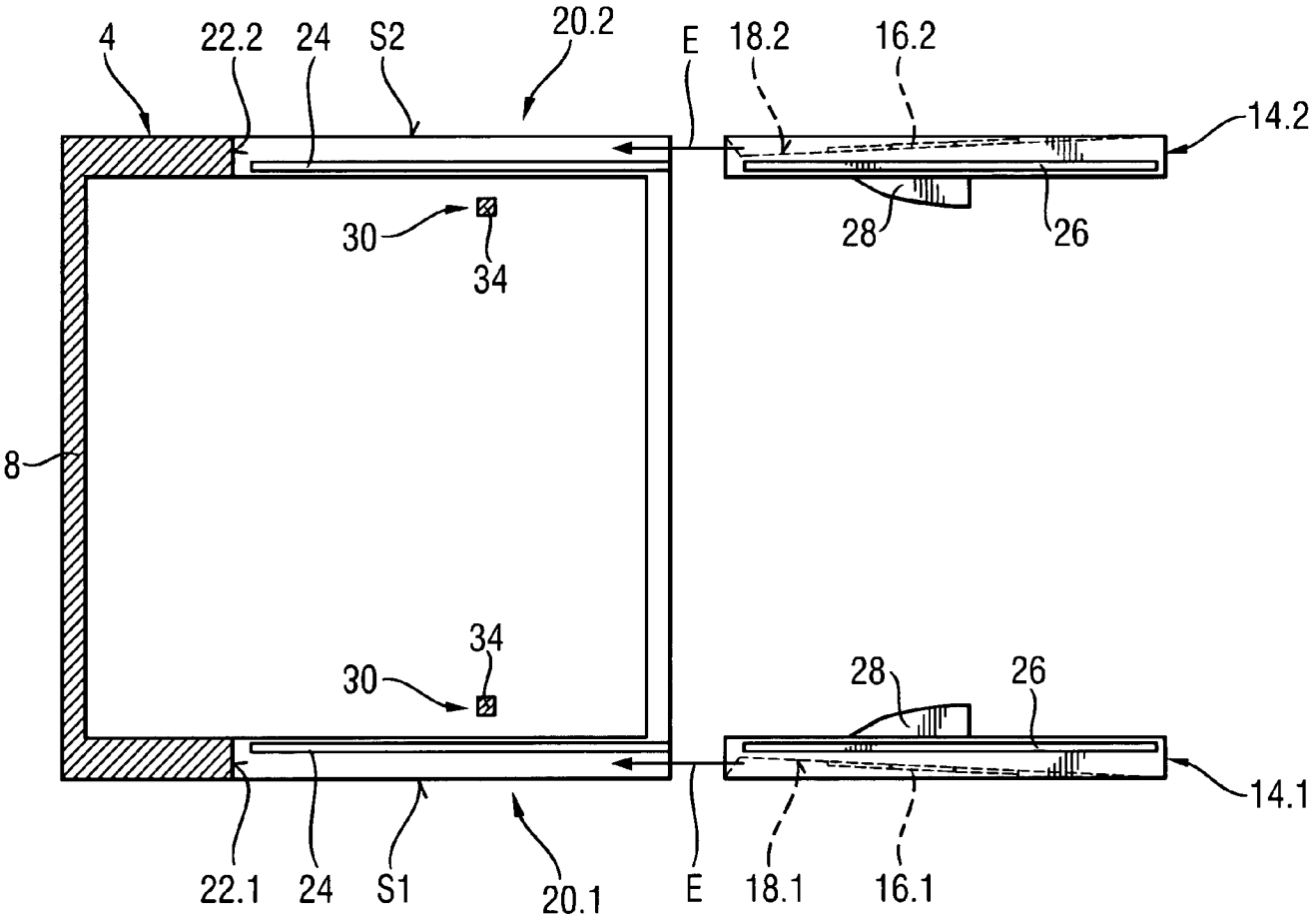
FIG. 3 a cross-sectional view along line III-III in FIG. 2.

FIGS. 2-3 show the motor housing part 8 separately and before installation of the first identification element 14.1. As can be seen in FIG. 3, a second, likewise tag-shaped, identification element 14.2 is provided on a second side S2 of the housing 4 opposite the first side S1. The second identification element carries a second identification 16.2 that corresponds to the first identification mark 16.1. Both identifications 16.1, 16.2 are located in respective recesses 18.1, 18.2 formed in the corresponding identifications 14.1, 14.2, and are visible from outside of the housing 4.

As further shown in FIGS. 2-3, a receptacle 20.1, 20.2 is provided on each side S1, S2. The receptacle 20.1, 20.2 is formed by a respective recess 22.1, 22.2 in the housing 4, which is limited by opposite guides 24. The guides 24 serve for receiving complementary counter-guides 26 provided on the identification elements 14.1, 14.2. The guides 24 and counter-guides 26 can form, as shown, groove and spring connections.

As particularly shown in FIG. 3, a rib-shaped formlocking element 28 is provided on each of the identification elements 14.1, 14.2. When the identification elements 14.1, 14.2 are pushed in a displacement direction E, the formlocking elements 28 are pressed against respective locking regions 30 of respective third housing elements 32 (FIG. 2). In the embodiment shown in the drawings, the locking regions are formed by an elastic bar lock 34, and the housing element 32 is formed by an air guide that is inserted in the motor housing 8 at its upper end 12, with the bar lock 34 extending therefrom (see FIG. 2).

As soon as the end position of the first identification element 14.1, which is shown in FIG. 1, or, correspondingly, the end position of the second identification element 14.2 is reached, the bar lock 34 snaps behind the formlocking element 28 which, thus, abuts the bar lock 34 in a direction opposite the displacement direction E. Thereby, the identification elements 14.1, 14.2 are secured in the housing 4 in their inserted position.

Alternatively, it is possible to form the locking region 30 by a rigid region of the third housing element 32. For securing the identification elements 14.1, 14.2 in the housing 4, they are pushed into the receptacles 20.1, 20.2, and only then the third housing element is placed in the housing 4 in order to provide a formlocking connection between the locking region 30 and the formlocking element 28 and which would act in a direction opposite the displacement direction E of the identification elements 14.1 and 14.2.

In each case, both the identification elements 14.1, 14.2 and the receptacle 20.1, 20.2 taper in the displacement direction in order to achieve a precise positioning during insertion of the identification elements 14.1, 14.2.

Figure 4:
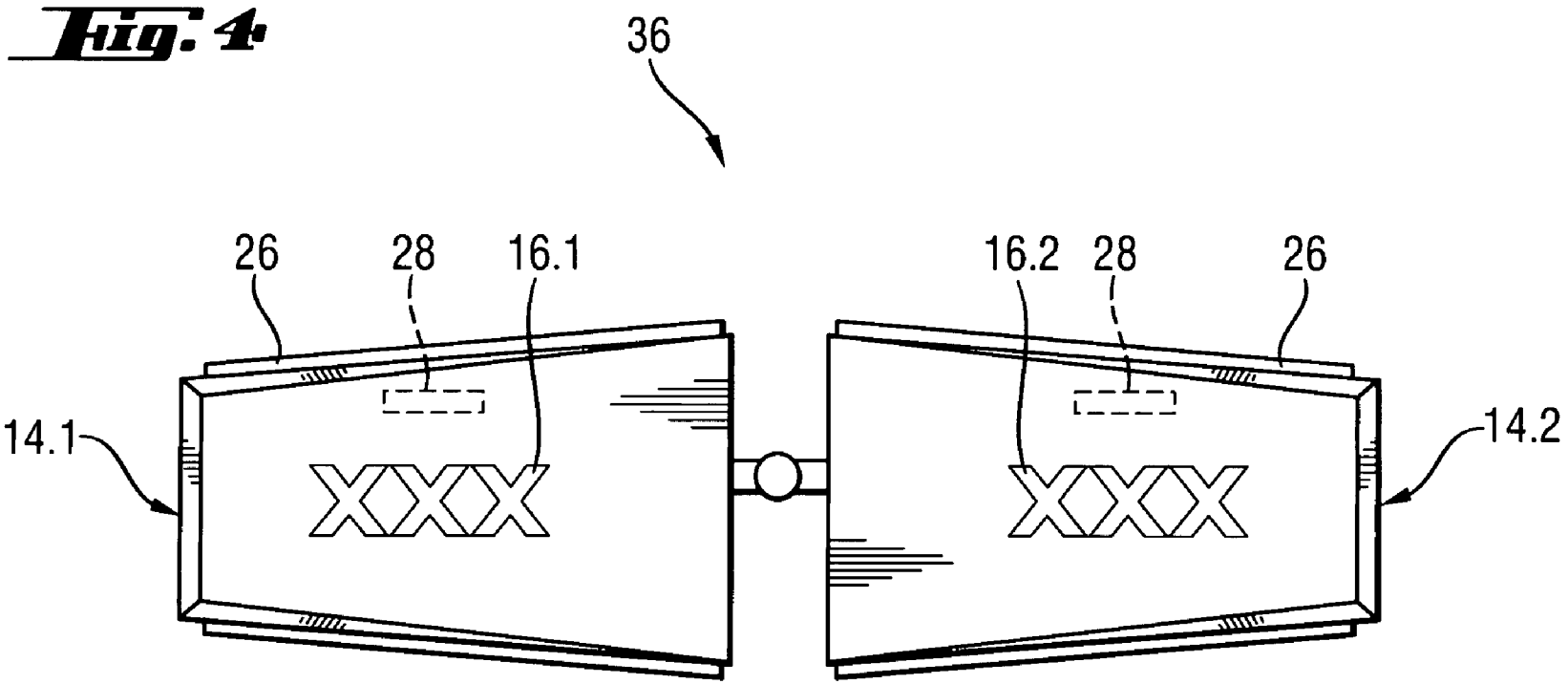
FIG. 4 a side view of a cast element with two identification elements.

As shown in FIG. 4, both identification elements 14.1, 14.2, which are received in the receptacle 20.1, 20.2 of the power tool 2, are formed by parts of a single cast element 36 that is produced separately from a conventional housing 4. After the identification elements 14.1, 14.2 have been formed, the identification marks 16.1, 16.2 are placed on the single-piece cast piece 36. Only a single common printing process is necessary for placing the identification marks on the identification elements 14.1, 14.2. Only then, the two identification elements 14.1, 14.2 are separated from each other for securing them in the housing 4 during the final assembly in accordance with the above-described procedure.

Though the present invention was shown and described with references to the preferred embodiment, such is merely illustrative of the present invention and is not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising a housing (4); and an identification element (14.1; 14.2) mountable on the housing (4) so that it becomes visible on an outer side of the housing (4), the identification element (14.1; 14.2) being provided with an identification mark (16.1; 16.2) and formed as a tag, and the housing (4) having a receptacle (20.1; 20.2) into which the tag-shaped identification element (14.1; 14.2) is pushed; and an element (32) for securing the identification element (14.1; 14.2) in the receptacle (20.1; 20.2), wherein the securing element (32) is formed separately from the housing (4) and forms, in a mounted condition thereof in the housing (4), an inserted air guide.

2. A hand-held power tool according to claim 1, wherein the securing element (32) has a locking region (30), and the identification element (14.1; 14.2) has a formlocking element (28) that abuttingly engages the locking region (30) of the securing element (32) in a direction opposite a direction (E) in which the identification element (14.1; 14.2) is pushed into the receptacle (20.1; 20.2).

3. A hand-held power tool, according to claim 1, wherein the identification element (14.1; 14.2) has a recess (18.1; 18.2) in which the identification mark (16.1; 16.2) is received.

4. A hand-held power tool, according to claim 1, wherein the housing (4) has a recess (22.1; 22.2) in which the receptacle (20.1, 20.2) is provided.

5. A hand-held power tool, comprising a housing (4); and an identification element (14.1; 14.2) mountable on the housing (4) so that it becomes visible on an outer side of the housing (4), the identification element (14.1; 14.2) being provided with an identification mark (16.1; 16.2) and formed as a tag, an opening in the housing (4) forming a receptacle (20.1; 20.2) into which the tag-shaped identification element (14.1; 14.2) is pushed, wherein both the identification element (14.1; 14.2) and the receptacle (20.1; 20.2) taper in a direction (E) in which the identification element (14.1, 14.2) is pushed into the receptacle (20.1, 20.2).

* * * * *